US010401790B2

(12) United States Patent
Wakimoto

(10) Patent No.: US 10,401,790 B2
(45) Date of Patent: Sep. 3, 2019

(54) IMAGE FORMING APPARATUS INCLUDING AIR GENERATOR THAT IS DISPOSED WITHIN DUCT AND GENERATES AIR DIRECTED FROM INLET TO OUTLET OF DUCT

(71) Applicant: KYOCERA Document Solutions Inc., Osaka (JP)

(72) Inventor: Atsuhiro Wakimoto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/195,472

(22) Filed: Nov. 19, 2018

(65) Prior Publication Data

US 2019/0155214 A1 May 23, 2019

(30) Foreign Application Priority Data

Nov. 22, 2017 (JP) ..... 2017-224579

(51) Int. Cl.
*G03G 21/00* (2006.01)
*G03G 21/20* (2006.01)
*G03G 15/00* (2006.01)

(52) U.S. Cl.
CPC ..... *G03G 21/206* (2013.01); *G03G 15/6573* (2013.01); *G03G 2221/1645* (2013.01)

(58) Field of Classification Search
CPC ..... G03G 15/6573; G03G 21/206; G03G 2221/1645
USPC ..... 399/92
See application file for complete search history.

(56) References Cited

U.S. PATENT DOCUMENTS 8,218,157 B2 7/2012 Saito
8,228,513 B2 7/2012 Saito
2005/0158096 A1* 7/2005 Park ..... H04N 1/00 399/405
2007/0139731 A1 6/2007 Saito
2008/0038008 A1* 2/2008 Fujita ..... G03G 21/206 399/92
2010/0195130 A1 8/2010 Saito
2012/0087693 A1* 4/2012 Yamaguchi ..... G03G 21/206 399/92
2014/0341607 A1* 11/2014 Nakano ..... G03G 15/2017 399/92
2015/0338799 A1* 11/2015 Hamada ..... G03G 21/203 399/92

(Continued)

FOREIGN PATENT DOCUMENTS

JP 2002072729 A * 3/2002
JP 2007-188043 A 7/2007

*Primary Examiner* — Robert B Beatty
(74) *Attorney, Agent, or Firm* — Studebaker & Brackett PC

(57) ABSTRACT

An image forming apparatus includes an image forming section, a fixing device, an exit tray, a first conveyance section, a duct, and an air generator. The image forming section forms an image on a sheet. The fixing device fixes the image to the sheet. The exit tray receives placement of the sheet with the image fixed thereto. The first conveyance section conveys the sheet with the image formed thereon along a conveyance path. The duct has an inlet and a first outlet. The air generator is disposed within the duct and generates air directed from the inlet to the first outlet. The inlet is located in a position for sucking in air from a space above the exit tray. The first outlet opens toward the conveyance path.

12 Claims, 9 Drawing Sheets

(56) References Cited

U.S. PATENT DOCUMENTS

2016/0320749 A1* 11/2016 Komatsuzaki ..... G03G 21/206

* cited by examiner

IMAGE FORMING APPARATUS INCLUDING AIR GENERATOR THAT IS DISPOSED WITHIN DUCT AND GENERATES AIR DIRECTED FROM INLET TO OUTLET OF DUCT

INCORPORATION BY REFERENCE

The present application claims priority under 35 U.S.C. § 119 to Japanese Patent Application No. 2017-224579, filed on Nov. 22, 2017. The contents of this application are incorporated herein by reference in their entirety.

BACKGROUND

The present disclosure relates to an image forming apparatus.

A known image forming apparatus allows removal of matter such as odor and a volatile organic compound therefrom. The image forming apparatus includes an exit tray, an ejection section, and a suction exhaust section. The exit tray is accessible from the outside of the apparatus. Specifically, the exit tray is disposed in an interior space of a body of the image forming apparatus or in an upper portion of the image forming apparatus. The ejection section ejects recording media with images formed thereon out of the apparatus. The ejected recording media are stacked on the exit tray. The suction exhaust section sucks odor and a volatile organic compound emitted from the recording media. The sucked odor and volatile organic compound are exhausted through a filter.

SUMMARY

An image forming apparatus according to an aspect of the present disclosure includes an image forming section, a fixing device, an exit tray, a first conveyance section, a duct, and an air generator. The image forming section forms an image on a sheet. The fixing device fixes the image to the sheet. The exit tray receives placement of the sheet with the image fixed thereto. The first conveyance section conveys the sheet with the image formed thereon along a conveyance path. The duct has an inlet and a first outlet. The air generator is disposed within the duct and generates air directed from the inlet to the first outlet. The inlet is located in a position for sucking in air from a space above the exit tray. The first outlet opens toward the conveyance path.

DETAILED DESCRIPTION

Figure 1:
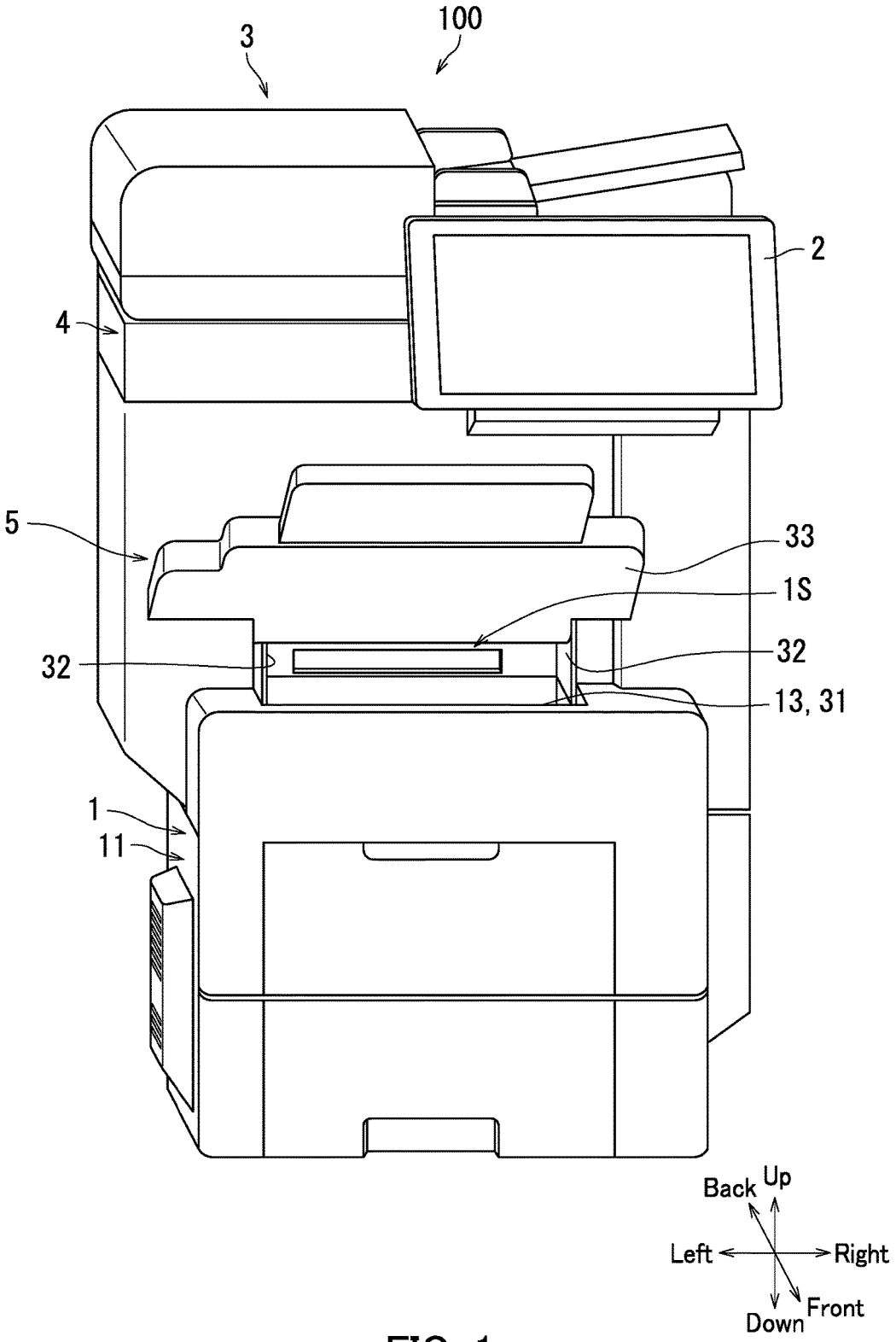
FIG. 1 is a diagram illustrating an image forming apparatus according to an embodiment of the present disclosure.

The following describes an embodiment of the present disclosure with reference to the accompanying drawings. Note that in the drawings, elements that are the same or substantially equivalent are labelled using the same reference signs and description thereof is not repeated.

[Image Forming Apparatus]

First, an image forming apparatus 100 will be described with reference to FIG. 1. FIG. 1 is a diagram illustrating the image forming apparatus 100. As illustrated in FIG. 1, the image forming apparatus 100 includes a printer 1, an operation panel 2, a document feeder 3, a reading device 4, and a post-processing device 5. The image forming apparatus 100 according to the present embodiment is a multifunction peripheral including the printer 1 and the post-processing device 5 attached to the printer 1.

The following describes the present embodiment on the assumption that a side having the operation panel 2 is a front side of the image forming apparatus 100 and a side opposite thereto is a back side of the image forming apparatus 100. The following also describes the present embodiment on the assumption that a right side of the image forming apparatus 100 as seen from the front side thereof is a right side of the image forming apparatus 100, and a side opposite thereto is a left side of the image forming apparatus 100. The following also describes the present embodiment on the assumption that a side having the document feeder 3 is an upper side of the image forming apparatus 100 and a side opposite thereto is a lower side of the image forming apparatus 100 in a direction orthogonal to a front-back direction and a left-right direction of the image forming apparatus 100.

The printer 1 forms images on sheets S. The printer 1 is disposed in a lower portion of the image forming apparatus 100. The printer 1 has a main body housing 11 and an exit tray 13. The main body housing 11 has a substantially rectangular parallelepiped shape.

The exit tray 13 is disposed on an upper surface 31 of the main body housing 11. The sheets S having images formed thereon are placed on the exit tray 13.

The operation panel 2 receives an instruction from a user to the image forming apparatus 100. The operation panel 2 according to the present embodiment is a touch panel.

The document feeder 3 conveys a document having a sheet shape. The document feeder 3 has a document placement tray, a document exit tray, and a document conveyance section. The document conveyance section conveys the document placed on the document placement tray one sheet at a time to the document exit tray via a reading position. The reading device 4 can read an image from the document when the document is in the reading position. The document feeder 3 is disposed above the reading device 4.

The reading device 4 reads the image from the document and outputs read image data. The reading device 4 includes a document table and a reading mechanism. The reading mechanism reads the image from the document on the document table and outputs the read image data. Alternatively, the reading mechanism reads the image from the document passing through the reading position and outputs the read image data. The reading device 4 according to the present embodiment is a scanner. The reading device 4 is disposed above the post-processing device 5.

The post-processing device 5 is a finisher. The finisher performs post-processing on sheets S. The post-processing includes punching, stapling, and aligning. The finisher is disposed above the printer 1. Specifically, the finisher is disposed above the main body housing 11.

The image forming apparatus 100 has an interior space 1*s*. The interior space 1*s* is between the upper surface 31 of the main body housing 11 and the post-processing device 5. Specifically, the image forming apparatus 100 includes two side wall surfaces 32 and a ceiling surface 33. The two side wall surfaces 32 are arranged in the left-right direction of the image forming apparatus 100 and face each other. The two side wall surfaces 32 are respectively stood on left and right end portions of the upper surface 31 of the main body housing 11. The two side wall surfaces 32 and the ceiling surface 33 surround a space above the exit tray 13. In other words, the interior space 1*s* is surrounded by the upper surface 31 of the main body housing 11, the exit tray 13, the side wall surfaces 32, and the ceiling surface 33. The two side wall surfaces 32 correspond to inner side surfaces of a coupling section that couples the printer 1 and the reading device 4. The ceiling surface 33 faces the upper surface 31 of the main body housing 11 in an up-down direction of the image forming apparatus 100. The ceiling surface 33 according to the present embodiment corresponds to a lowermost surface of the post-processing device 5.

Figure 2:
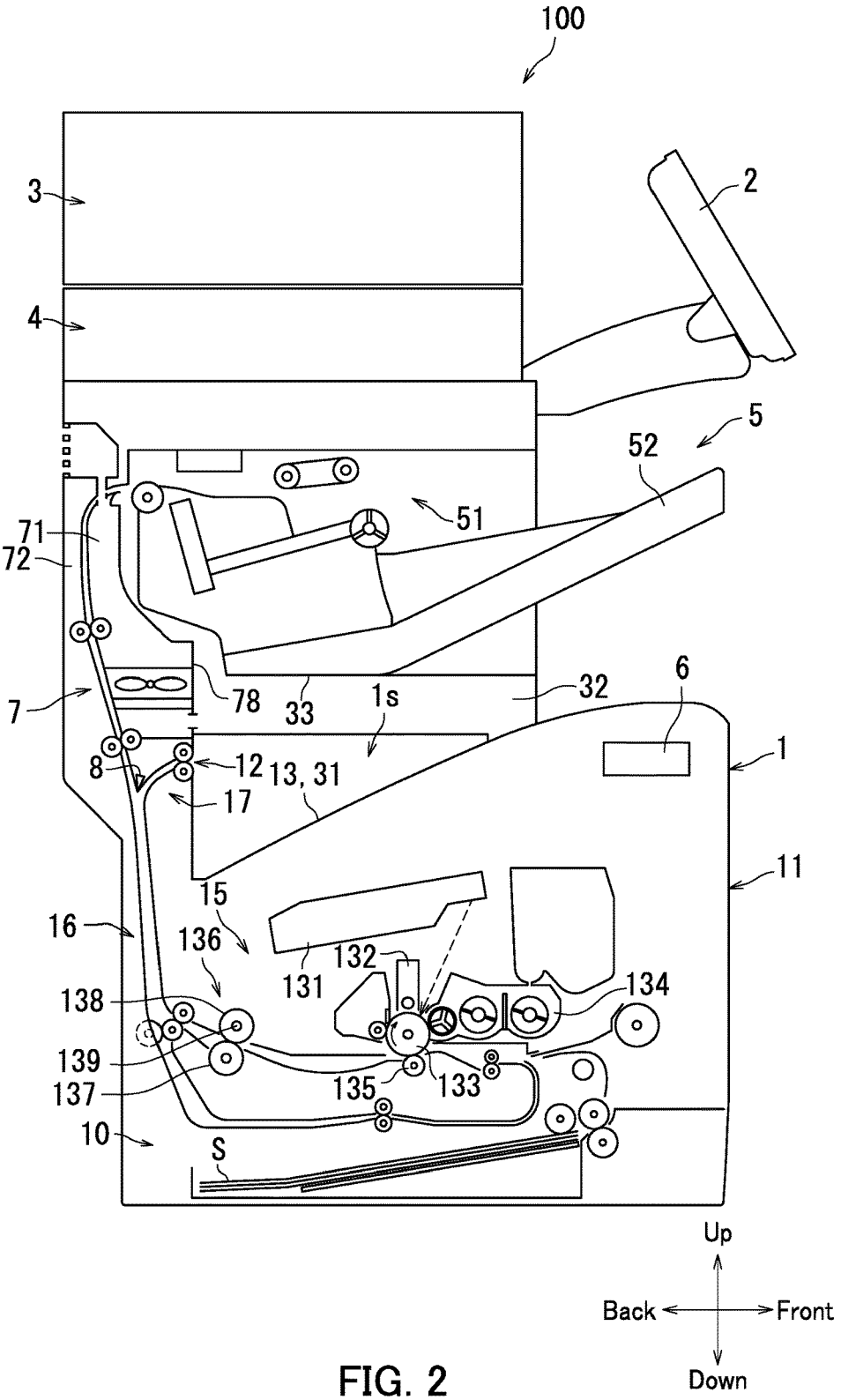
FIG. 2 is a diagram schematically illustrating the image forming apparatus according to the embodiment of the present disclosure.

Next, the image forming apparatus 100 according to the present embodiment will be further described with reference to FIGS. 1 and 2. FIG. 2 is a diagram schematically illustrating the image forming apparatus 100.

As illustrated in FIG. 2, the image forming apparatus 100 further includes a controller 6, a first conveyance section 7, a diverging section 8, and a duct 78. The duct 78 will be described below with reference to FIGS. 3 to 5.

The controller 6 includes a processor such as a central processing unit (CPU). The controller 6 controls operation of each section of the image forming apparatus 100 by executing a control program. The controller 6 also includes an integrated circuit for image formation. The integrated circuit for image formation is for example an application specific integrated circuit (ASIC). Receiving a job such as a copy job, for example, the controller 6 controls operation of each section of the image forming apparatus 100 to form an image on a sheet S. The job is for example received through the user operating the operation panel 2.

The printer 1 has a configuration of a common printer. Specifically, the printer 1 includes a sheet feeder 10, an image forming section 15, a fixing device 136, a second conveyance section 16, and an ejection section 17 in addition to the main body housing 11. The sheet feeder 10, the image forming section 15, the second conveyance section 16, and the ejection section 17 are housed within the main body housing 11.

The sheet feeder 10 contains the sheets S and feeds the sheets S therefrom one sheet at a time.

The image forming section 15 forms an image on a sheet S. The image forming section 15 according to the present embodiment forms an image on a sheet S by an electrophotographic process. The image forming section 15 has a light exposure device 131, a charger 132, a photosensitive drum 133, a development device 134, and a transfer device 135. Specifically, the light exposure device 131 forms an electrostatic latent image on a surface of the photosensitive drum 133 based on image data. The charger 132 charges the surface of the photosensitive drum 133 to a predetermined potential. The development device 134 supplies toner to the photosensitive drum 133 to develop the electrostatic latent image on the photosensitive drum 133 into a toner image. The transfer device 135 is disposed opposite to the photosensitive drum 133. The transfer device 135 and the photosensitive drum 133 form a transfer nip therebetween. The toner image on the photosensitive drum 133 is transferred to the sheet S as a result of the sheet S passing through the transfer nip.

The fixing device 136 fixes the transferred toner image to the sheet S. Specifically, the fixing device 136 includes a pressure member 137, a heat member 138, and a heat source 139. The heat member 138 is for example a heating roller. The pressure member 137 is for example a pressure roller. The heat source 139 is for example a halogen heater. The heat source 139 is disposed within the heat member 138 and heats the heat member 138. The pressure member 137 is disposed opposite to the heat member 138. The pressure member 137 and the heat member 138 form a fixing nip therebetween. The toner image transferred onto the sheet S is fixed to the sheet S as a result of the sheet S passing through the fixing nip.

The second conveyance section 16 conveys the sheet S fed by the sheet feeder 10 to the diverging section 8 by way of the image forming section 15 and the fixing device 136. The second conveyance section 16 includes a plurality of rollers and a guide member. An upstream end of the second conveyance section 16 is connected with the sheet feeder 10. A downstream end of the second conveyance section 16 is connected with the diverging section 8.

The ejection section 17 ejects the sheet S onto the exit tray 13 through a sheet exit port 12. The sheet exit port 12 is formed in a position in the main body housing 11 and opens toward the interior space is. A plurality of sheets S can be stacked on the exit tray 13. The maximum number of sheets S that can be stacked on the exit tray 13 is also referred to below as a "loadable sheet number".

The diverging section 8 is turnable. An angle of the diverging section 8 is changed by turning the diverging section 8. A conveyance destination of the sheet S conveyed by the second conveyance section 16 switches between the ejection section 17 and the first conveyance section 7 depending on the angle of the diverging section 8.

The post-processing device 5 includes an optional processing section 51 and an optional exit tray 52. The optional processing section 51 for example includes a puncher, a processing tray, and a stapler. The puncher punches one or more sheets S. The stapler staples a plurality of sheets S stacked on the processing tray. The plurality of sheets S is for example a sheaf of sheets S. The sheets S subjected to optional processing are ejected onto the optional exit tray 52.

The first conveyance section 7 conveys the sheet S with the image fixed thereto to the post-processing device 5 along a specific conveyance path. In other words, the first conveyance section 7 conveys the sheet S from the second conveyance section 16 to the post-processing device 5. The first conveyance section 7 includes a plurality of rollers and a guide member. The first conveyance section 7 according to the present embodiment conveys the sheet S upward. A downstream end of the first conveyance section 7 is connected with the post-processing device 5. An upstream end of the first conveyance section 7 is connected with the diverging section 8. The first conveyance section 7 is connected with the second conveyance section 16 with the diverging section 8 therebetween.

The first conveyance section 7 has a first guide member 71 and a second guide member 72. The first guide member 71 and the second guide member 72 are disposed opposite to each other and form the specific conveyance path. The first guide member 71 is an example of what is referred to as a guide member.

According to the present embodiment, the first guide member 71 and the second guide member 72 function as the coupling section that couples the printer 1 and the reading device 4. The second guide member 72 also functions as a covering member of the image forming apparatus 100. The covering member is for example an exterior.

Figure 3:
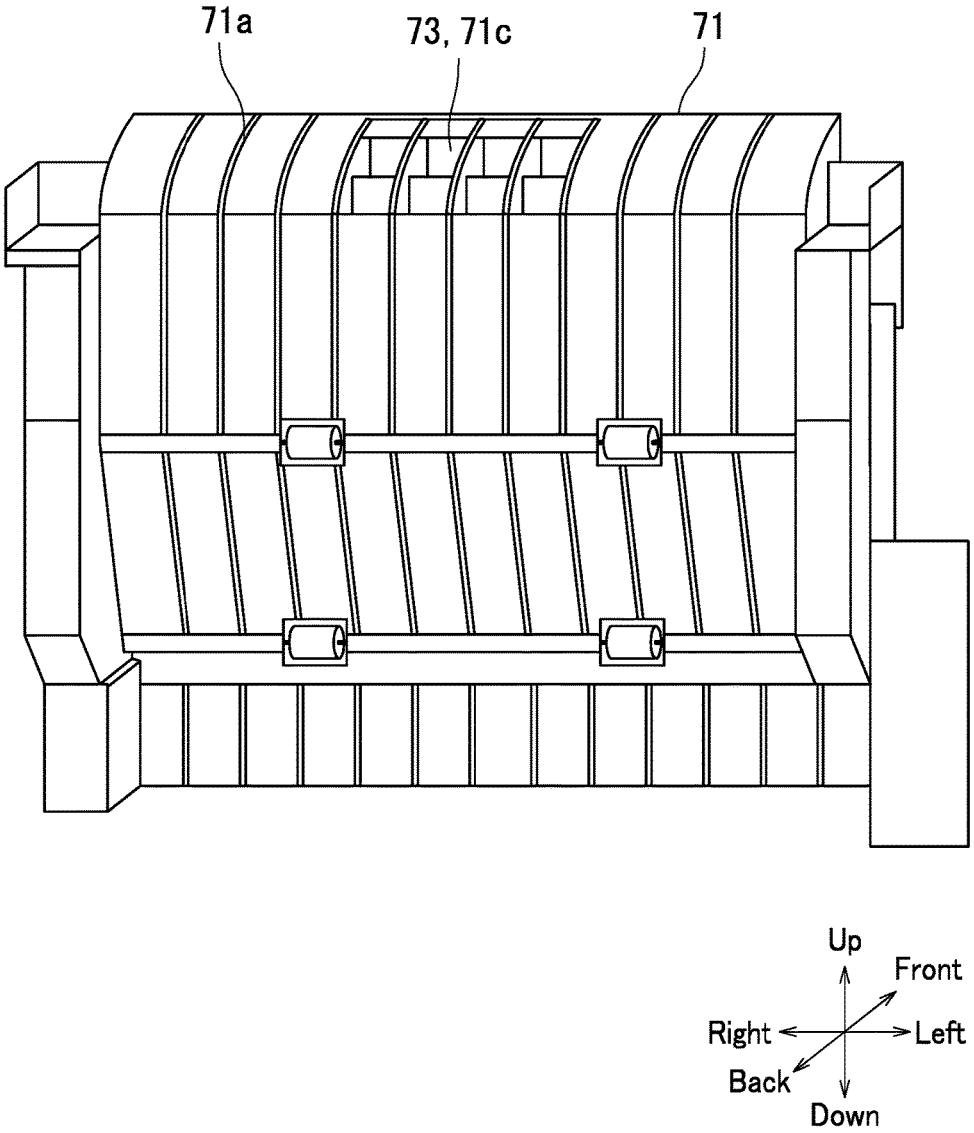
FIG. 3 is a diagram illustrating a configuration of a first guide member according to the embodiment of the present disclosure.
Figure 4:
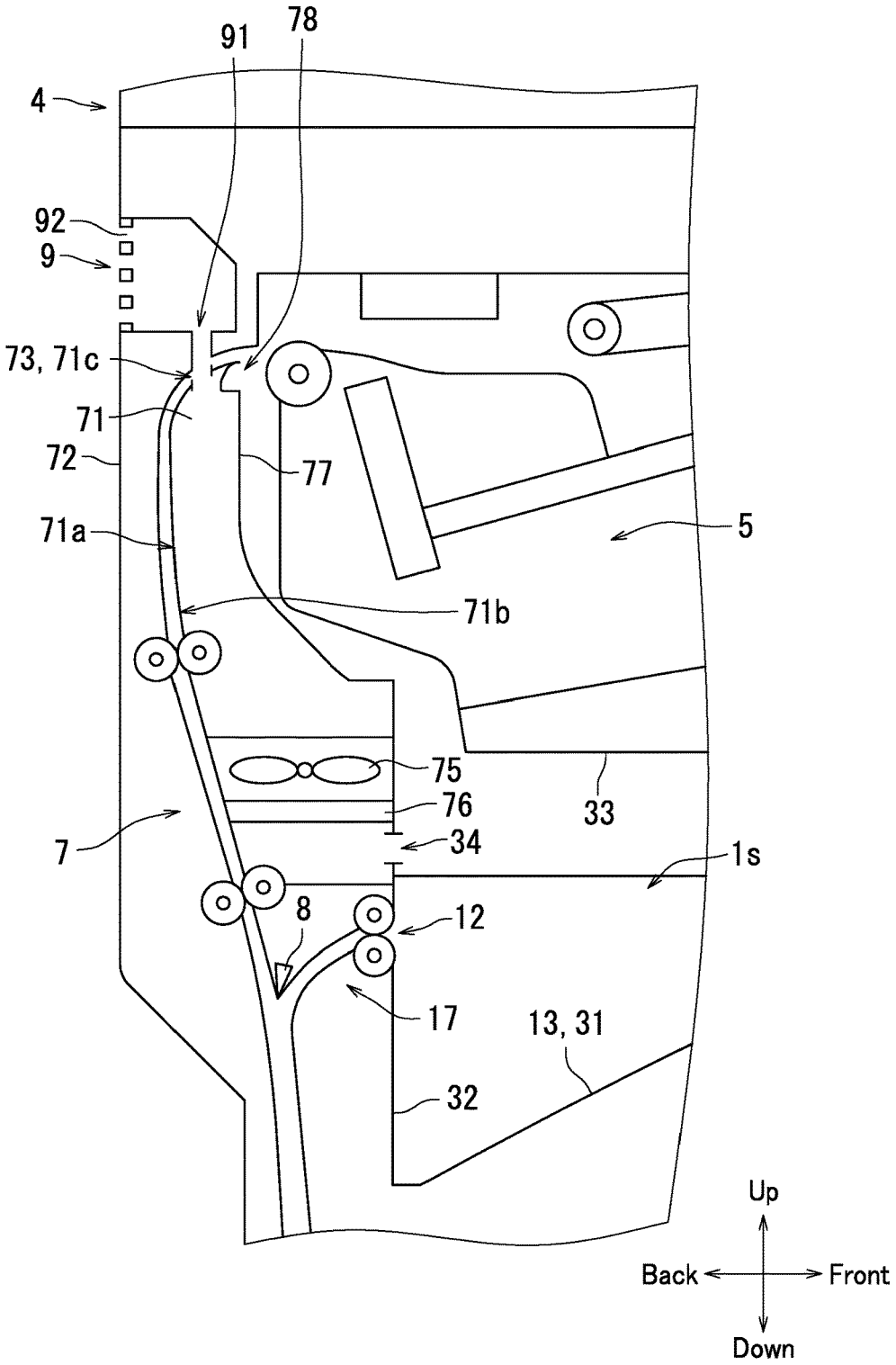
FIG. 4 is a diagram schematically illustrating a first conveyance section and the vicinity thereof according to the embodiment of the present disclosure.
Figure 5:
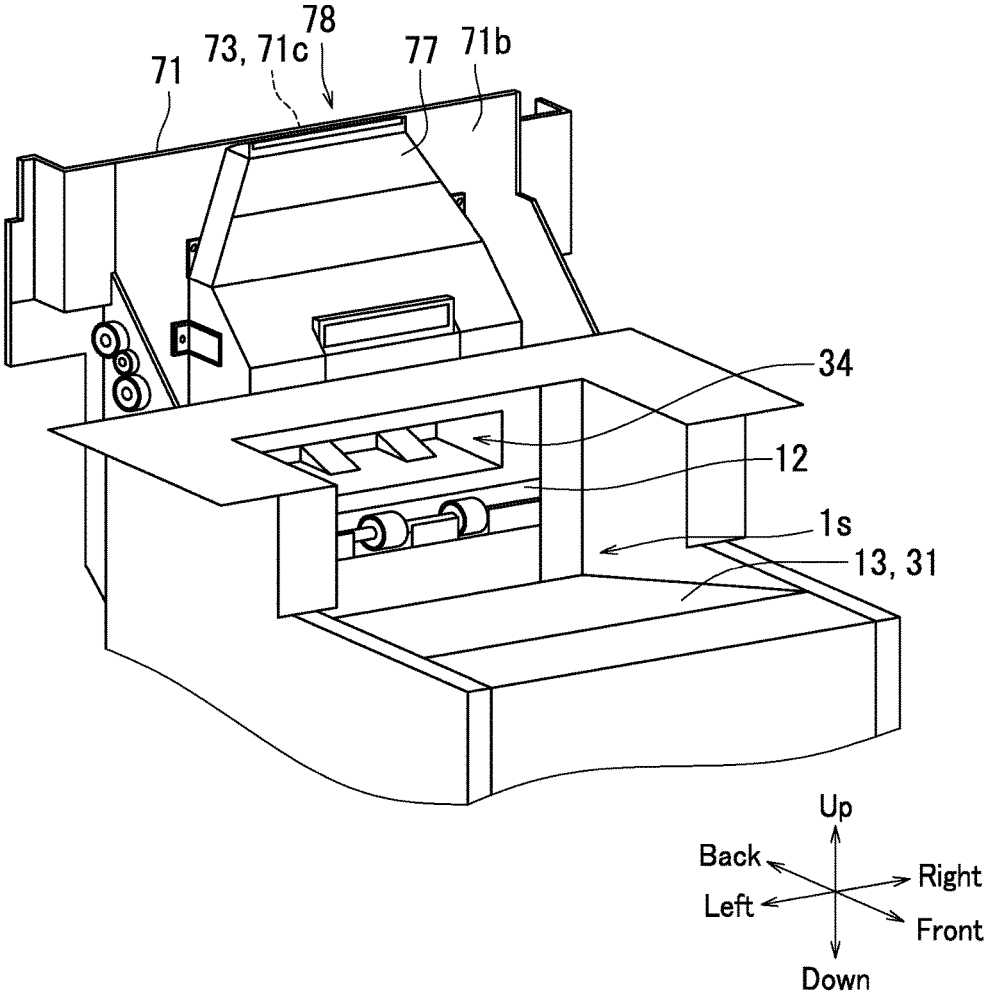
FIG. 5 is a perspective view illustrating a configuration of a duct according to the embodiment of the present disclosure.

The following describes a configuration of the first guide member 71 with reference to FIGS. 3 to 5. FIG. 3 is a diagram illustrating the configuration of the first guide member 71. Specifically, FIG. 3 illustrates the first guide member 71 as viewed from the back side of the image forming apparatus 100. FIG. 4 is a diagram schematically illustrating the first conveyance section 7 and the vicinity thereof. FIG. 5 is a perspective view illustrating a configuration of the duct 78. Specifically, FIG. 5 illustrates a portion of the image forming apparatus 100 without the operation panel 2, the document feeder 3, the reading device 4, and the post-processing device 5. Note that FIG. 5 is a left front top view of the image forming apparatus 100.

As illustrated in FIGS. 3 and 4, the first guide member 71 is for guiding conveyance of the sheet S. The first guide member 71 has a guide surface 71*a* for guiding conveyance of the sheet S. The guide surface 71*a* faces the second guide member 72 described with reference to FIG. 2.

The first guide member 71 has an attachment surface 71*b* as illustrated in FIGS. 4 and 5. The attachment surface 71*b* receives attachment of a duct member 77 described below. According to the present embodiment, the first guide member 71 has an opening 71*c*. The opening 71*c* functions as an outlet of the duct 78. Specifically, the opening 71*c* functions as a first outlet 73 of the duct 78. In other words, the first outlet 73 opens toward the conveyance path of the first conveyance section 7.

The following describes the duct 78 with reference to FIGS. 3 to 5. As illustrated in FIGS. 4 and 5, the duct 78 has a hollow structure and includes the duct member 77, an inlet 34, and the first outlet 73. According to the present embodiment, a portion of the first guide member 71 and the duct member 77 form the duct 78. The portion of the first guide member 71 means the attachment surface 71*b*. Specifically, the duct member 77 is attached to the attachment surface 71*b* to form the duct 78. The duct 78 extends from the inlet 34 to the first outlet 73. Specifically, the duct 78 extends in an extending direction of the first conveyance section 7. A direction orthogonal to the extending direction of the duct 78 is also referred to below as a "width direction".

The first outlet 73 according to the present embodiment is located in an upper portion of the duct 78. The first outlet 73 is located in an upper portion of the first guide member 71 (see FIG. 3). The inlet 34 is located in a position for sucking in air from the space above the exit tray 13. Such a configuration ventilates the interior space 1*s* through the inlet 34. It is preferable to ventilate the interior space 1*s* because the air within the interior space 1*s* tends to be stagnant. Specifically, odor and the like are emitted by the sheet S ejected into the interior space is but can be removed from the interior space 1*s* by the ventilation.

The inlet 34 according to the present embodiment is formed above the sheet exit port 12. Specifically, the inlet 34 is formed in a position that prevents the inlet 34 from being blocked when the sheets S are stacked on the exit tray 13. More specifically, the inlet 34 is formed in a position that prevents the inlet 34 from being blocked even when the number of the sheets S stacked on the exit tray 13 reaches the loadable sheet number. Thus, obstruction of the ventilation of the interior space 1*s* is prevented.

As illustrated in FIGS. 3 and 5, a width of the first outlet 73 in the width direction is smaller than a width of the inlet 34 in the width direction. As a result of the first outlet 73 having a smaller width than the inlet 34, it is possible to blow strengthened air to each sheet S. It is therefore possible to cool the sheet S effectively.

Figure 6:
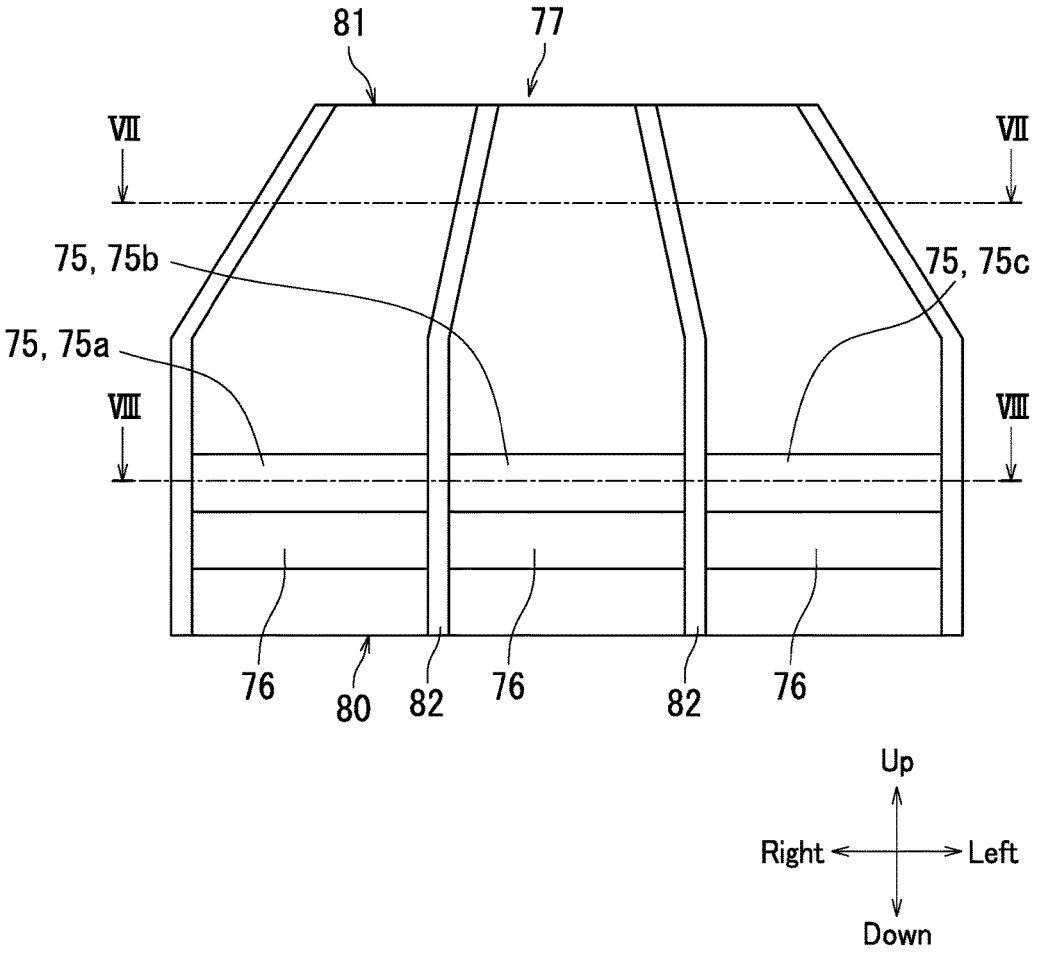
FIG. 6 is a diagram illustrating a duct member according to the embodiment of the present disclosure.
Figure 7:
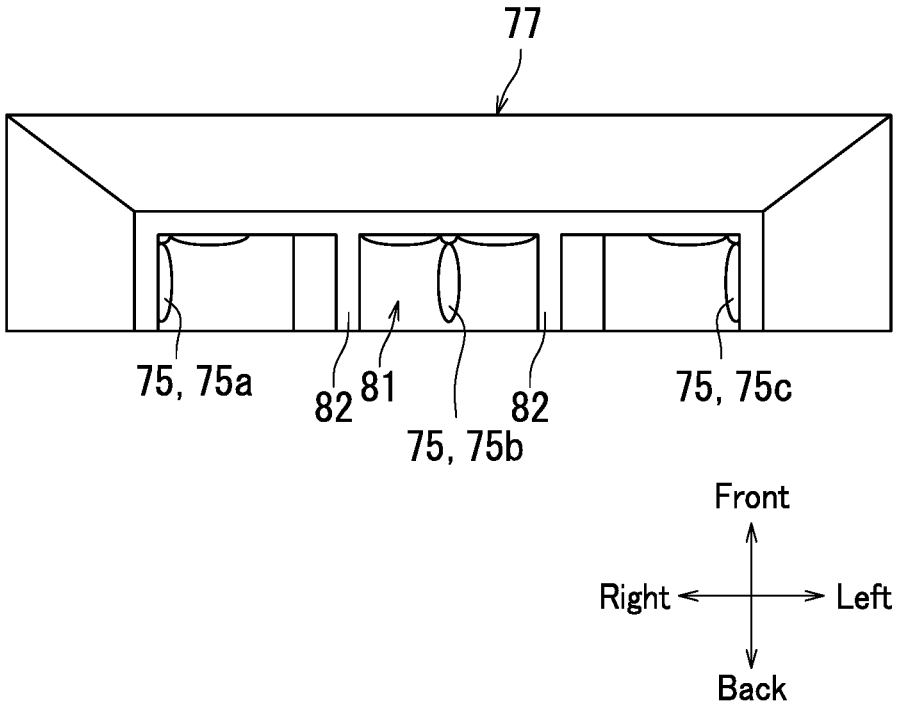
FIG. 7 is a cross-sectional view taken along line VII-VII in FIG. 6.
Figure 8:
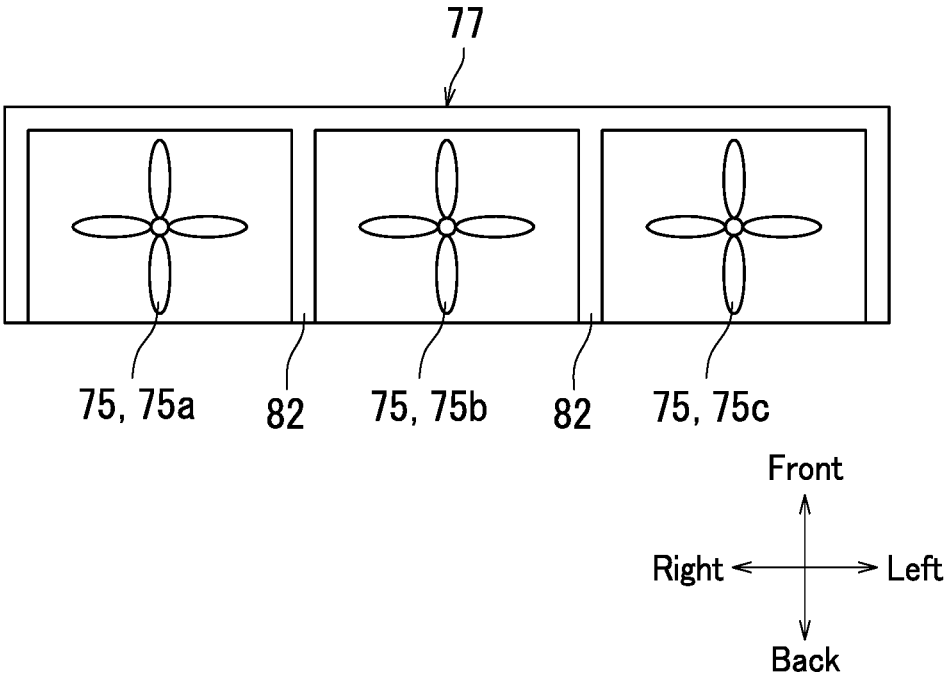
FIG. 8 is a cross-sectional view taken along line VIII-VIII in FIG. 6.

The following describes the duct member 77 with reference to FIGS. 6 to 8. FIG. 6 is a diagram illustrating the duct member 77. Specifically, FIG. 6 illustrates the duct member 77 as viewed from the first guide member 71. The duct member 77 as viewed from the guide member 71 means the duct member 77 as viewed from the back side of the image forming apparatus 100. FIG. 7 is a cross-sectional view taken along line VII-VII in FIG. 6. FIG. 8 is a cross-sectional view taken along line VIII-VIII in FIG. 6.

As illustrated in FIG. 6, the duct member 77 has a first end 80 and a second end 81. The first end 80 has the inlet 34 (see FIG. 5). The first end 80 has an opening. The first end 80 is an end adjacent to the printer 1 in the extending direction of the duct 78 (see FIG. 4). The second end 81 is an end adjacent to the post-processing device 5 (see FIG. 4) among the two ends in the extending direction of the duct 78.

The second end 81 of the duct member 77 has an opening. The duct member 77 is attached to the attachment surface 71*b* of the first guide member 71 such that the second end 81 faces the opening 71*c* (see FIG. 3) of the first guide member 71.

A width of the second end 81 is smaller than a width of the first end 80. Specifically, a width of the duct member 77 becomes increasingly small toward the second end 81 from a location midway between the first end 80 and the second end 81. A width of the opening in the first end 80 is smaller than a width of the opening in the second end 81.

The duct member 77 further includes a plurality of partitioning members 82 as illustrated in FIGS. 6 to 8. Each of the partitioning members 82 is for example a rib. Each of the partitioning members 82 connects to the attachment surface 71*b* of the first guide member 71 when the duct member 77 is attached to the attachment surface 71*b* of the first guide member 71. The partitioning members 82 extend continuously from the first end 80 to the second end 81. Each of the partitioning members 82 changes its extending direction (angle) according to the change in the width of the duct member 77.

The partitioning members 82 are located between the first guide member 71 and the duct member 77. The partitioning members 82 divide an inner space of the duct 78 into a plurality of spaces. The example illustrated in FIGS. 6 to 8 has two partitioning members 82, and accordingly the inner space is divided by the partitioning members 82 into three spaces.

The following describes a suction fan 75 with reference to FIGS. 4 to 8. As illustrated in FIG. 4, the image forming apparatus 100 further includes the suction fan 75. The suction fan 75 is disposed within the duct 78. The suction fan 75 sucks air from the interior space is through the inlet 34 and sends the air into the duct 78. The suction fan 75 generates air directed toward the first outlet 73 from the inlet 34.

As illustrated in FIGS. 6 to 8, the image forming apparatus 100 according to the present embodiment includes three suction fans 75. The suction fans 75 are equivalent to an example of what is referred to as an "air generator". The three suction fans 75 are arranged in the width direction orthogonal to an extending direction of the duct member 77. Specifically, the three suction fans 75 are respectively disposed in the three spaces separated by the partitioning members 82. In other words, the partitioning members 82 form three flow paths that allow the air generated by the suction fans 75 to flow from the first end 80 to the second end 81. The three suction fans 75 are also referred to below as a "first suction fan 75*a*", a "second suction fan 75*b*", and a "third suction fan 75*c*". The three suction fans 75 in the flow paths are located downstream of odor filters 76 described below.

The first suction fan 75*a* and the third suction fan 75*c* respectively correspond to opposite ends of each sheet S ejected onto the exit tray 13 (see FIG. 4) in a width direction of the sheet S. The second suction fan 75*b* corresponds to a middle portion of the sheet S.

Operation of the first, second, and third suction fans 75*a*, 75*b*, and 75*c* is controlled by the controller 6 described with reference to FIG. 2. The controller 6 according to the present embodiment controls driving force of the suction fans 75 for each suction fan 75 separately. The controller 6 controls the driving force of the suction fans 75 so that the driving force of the first suction fan 75*a* and the driving force of the third suction fan 75*c* are greater than the driving force of the second suction fan 75*b*. As a result, odor and the like emitted from the ends of the sheet S can be effectively removed from the interior space 1*s*.

Specifically, the sheet S obtains a high temperature due to heat from the heat member 138 as a result of passing through the fixing nip described with reference to FIG. 2. In particular, the ends of the sheet S tend to become hotter than the middle portion thereof. The ends of the sheet S are therefore more likely to emit odor and the like. According to the present embodiment, odor and the like can be effectively removed from the interior space is by giving greater driving force to the suction fans 75 corresponding to the ends of the sheet S. The suction fans 75 corresponding to the ends of the sheet S are for example the first suction fan 75*a* and the third suction fan 75*c*.

The sheet S also contains moisture and may therefore generate vapors when at a high temperature. In particular, the ends of the sheet S, which tend to be hotter, are more likely to generate vapors. According to the present embodiment, vapors (steam) generated from the sheet S can be effectively removed by giving greater driving force to the suction fans 75 corresponding to the ends of the sheet S.

The vapors generated from the sheet S may flow along the conveyance path of the first conveyance section 7 (see FIG. 4). According to the present embodiment, the width of the first outlet 73 of the duct 78 is smaller than the width of the inlet 34. As a result, a flow rate of the air to be exhausted through the first outlet 73 is increased to be high enough to diffuse the vapors (steam) flowing along the conveyance path of the first conveyance section 7 (see FIG. 4) and thus prevent the steam from being released out of the apparatus.

The vapors generated from the sheet S may form condensation on a sheet conveyance path in the post-processing device 5 (see FIG. 4). Moisture can cause an image defect and therefore needs to be removed. According to the present embodiment, the flow rate of the air to be exhausted through the first outlet 73 is increased. It is therefore possible to effectively cool the sheet S and thus prevent formation of condensation on the sheet conveyance path in the post-processing device 5 (see FIG. 4).

Note that the controller 6 may control the driving force of the first to third suction fans 75*a* to 75*c* according to the width of the sheet S. For example, the controller 6 may control the driving force of the first to third suction fans 75*a* to 75*c* so that the driving force of the second suction fan 75*b* is greater than the driving force of the first suction fan 75*a* and the driving force of the third suction fan 75*c*. As a result, power can be saved in a situation in which the sheet S is small-sized.

According to the present embodiment, the partitioning members 82 form independent flow paths respectively corresponding to the first to third suction fans 75*a* to 75*c*. Such a configuration effectively restricts turbulence from being created in the air to be exhausted through the first outlet 73 compared to a configuration that does not have independent flow paths respectively corresponding to the first to third suction fans 75*a* to 75*c*. This is true even if the driving force of the first suction fan 75*a* and the driving force of the third suction fan 75*c* are greater than the driving force of the second suction fan 75*b*. Accordingly, the sheet S being conveyed by the first conveyance section 7 tends not to be misdirected, allowing stable conveyance of the sheet S to the post-processing device 5.

Note that the controller 6 may control the driving force of the first to third suction fans 75*a* to 75*c* so that the driving force of the first suction fan 75*a* and the driving force of the third suction fan 75*c* are equal to each other. Such a configuration effectively restricts turbulence from being created in the air to be exhausted through the first outlet 73, allowing stable conveyance of the sheet S to the post-processing device 5.

Figure 9:
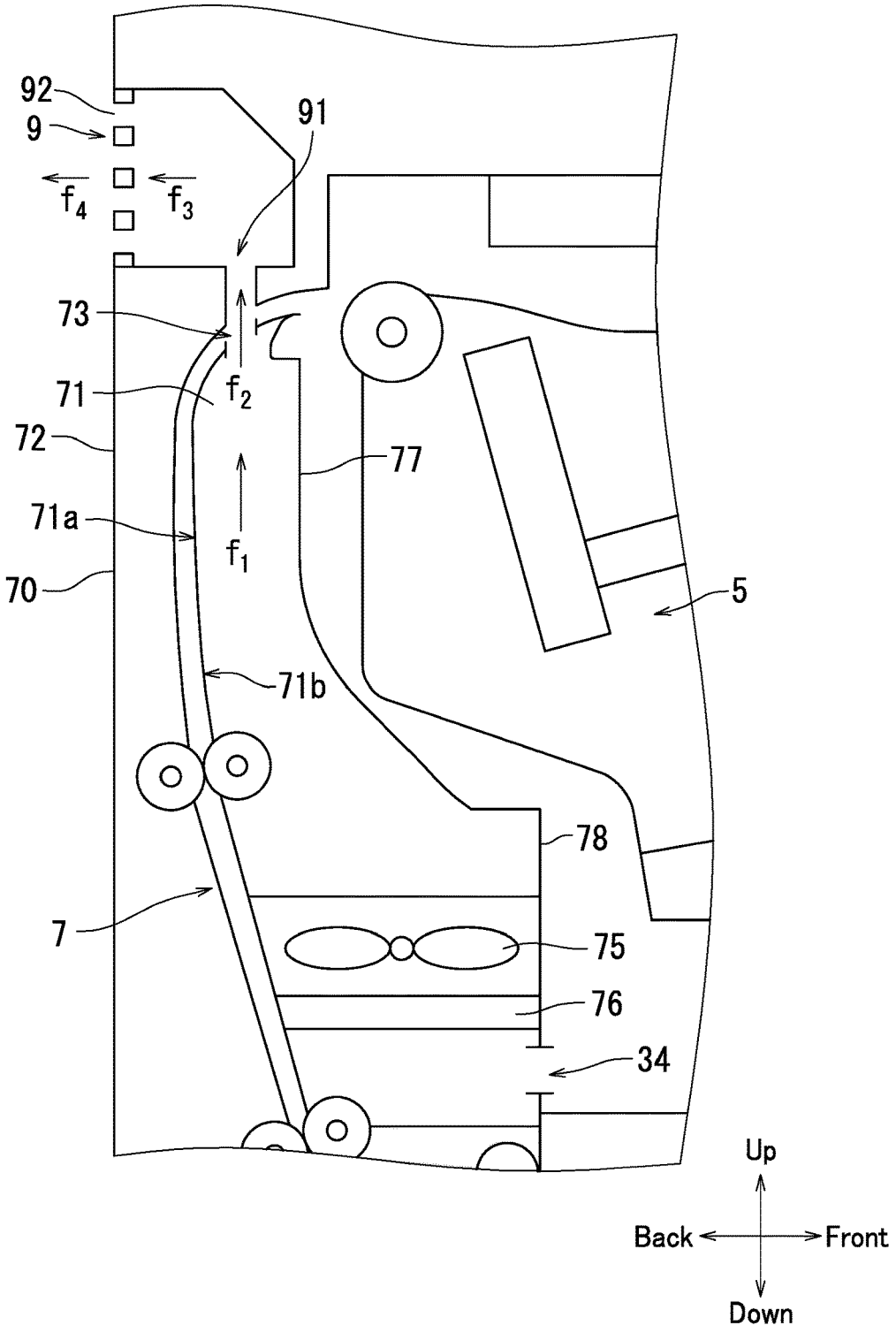
FIG. 9 is a cross-sectional view of the duct and a cover according to the embodiment of the present disclosure.

The following describes the odor filters 76 with reference to FIGS. 6 and 9. FIG. 9 is a cross-sectional view of the duct 78 and a cover 9. As illustrated in FIG. 6, the image forming apparatus 100 includes the three odor filters 76. The three odor filters 76 filter the air flowing through the duct 78. The odor filters 76 remove foreign matter such as fine particles in the air sucked through the inlet 34. The odor filters 76 may contain activated carbon.

As illustrated in FIG. 6, the three odor filters 76 are disposed between the first end 80 and the suction fans 75 in the duct member 77. In other words, the three odor filters 76 are disposed between the inlet 34 (see FIG. 9) and the suction fans 75. The three odor filters 76 are respectively disposed in the three spaces separated by the partitioning members 82 of the duct member 77. Specifically, the odor filters 76 are disposed in the vicinity of the inlet 34.

As illustrated in FIG. 9, the duct 78 guides the air sucked by the suction fans 75 to the first outlet 73. The air sucked by the suction fans 75 flows to the first outlet 73 through the inner space of the duct 78 as indicated by an arrow f1 in FIG. 9.

As illustrated in FIG. 9, the image forming apparatus 100 includes the cover 9. The cover 9 has an air inlet 91 and a second outlet 92. The cover 9 covers an upper portion of the conveyance path of the first conveyance section 7. The air inlet 91 is located opposite to the first outlet 73 with the conveyance path of the first conveyance section 7 therebetween. The second outlet 92 is in communication with the outside of the image forming apparatus 100.

The air generated by the suction fans 75 is exhausted through the first outlet 73, and then exhausted through the second outlet 92 via the conveyance path. Specifically, as illustrated in FIG. 9, the air flowing to the first outlet 73 as indicated by the arrow f1 passes transversely across the conveyance path of the first conveyance section 7 and flows to the air inlet 91 as indicated by an arrow f2. In other words, such a flow path extends across the conveyance path of the first conveyance section 7. According to the present embodiment, the air generated by the suction fans 75 flows in a direction orthogonal to an image formation surface of the sheet S being conveyed by the first conveyance section 7. The image formation surface of the sheet S is a surface on which an image is formed by the image forming section 15. The above-described configuration allows the sheet S to be cooled effectively.

The air flowing through the air inlet 91 is exhausted out of the image forming apparatus 100 through the second outlet 92 as indicated by arrows f3 and f4.

The image forming apparatus 100 according to the present embodiment uses the suction fans 75 both for the ventilation of the interior space 1*s* and for the cooling of the sheet S. Such a configuration eliminates the need for providing both ventilation and cooling fans.

The air exhausted through the first outlet 73 after having passed through the duct 78 may contain moisture. In a configuration without the cover 9, moist air reaches the reading device 4 located above the first outlet 73. The moist air may cause a defect in an electronic device. As long as the cover 9 is provided, however, it is possible to exhaust the air while preventing moist air from reaching the reading device 4.

Through the above, an embodiment of the present disclosure has been described. According to the present embodiment, it is possible to remove odor emitted during printing while effectively cooling the sheet S. More specifically, the inlet 34 is located in a position for sucking in air from the space above the exit tray 13. The suction fans 75 suck in stagnant air from the interior space is through the inlet 34. The air generated by the suction fans 75 is exhausted through the first outlet 73, and then exhausted through the second outlet 92 via the conveyance path. Thus, the image forming apparatus 100 can ventilate the interior space 1*s* and cool the sheet S being conveyed by the first conveyance section 7. As a result, it is possible to remove odor emitted during printing while effectively cooling the sheet S. According to the present embodiment, the internal temperature of the post-processing device 5 can be prevented from increasing by cooling the sheet S. Furthermore, the sheet S can be prevented from curling during and after fixing.

According to the present embodiment, the width of the first outlet 73 is smaller than the width of the inlet 34. As a result, the flow rate of the air to be exhausted through the first outlet 73 is higher than the flow rate of the air sucked through the inlet 34. It is therefore possible to blow strengthened air to the sheet S. As a result, it is possible to cool the sheet S more effectively.

According to the present embodiment, the inner space of the duct 78 is partitioned by the partitioning members 82. Such a configuration effectively restricts turbulence from being created in the air to be exhausted through the first outlet 73. Turbulence in the air, if any, may cause misdirection of the sheet S being conveyed by the first conveyance section 7. Specifically, the sheet S may be conveyed askew. According to the present embodiment, however, turbulence is restricted from being created in the air, preventing the sheet S from being conveyed askew.

Furthermore, according to the present embodiment, the flow rate of the air to be exhausted through the first outlet 73 is increased, so that vapors (steam) can be diffused by the air. As a result, a user is unlikely to take vapors released out of the apparatus for smoke.

A configuration of the present embodiment including two partitioning members 82 is described as an example. However, the partitioning members 82 may be omitted. Alternatively, the apparatus may include one partitioning member 82 or three or more partitioning members 82. The number of partitioning members 82 may be varied depending on the number of suction fans 75.

According to the present embodiment, the air is strengthened through the duct member 77 having a varying width. According to another embodiment, however, the air may be strengthened through the driving force of the suction fans 75 being increased.

Embodiments of the present disclosure have been described above with reference to the drawings (FIGS. 1 to 9). However, the present disclosure is not limited to the above embodiments and may be implemented in various different forms that do not deviate from the gist of the present disclosure. Elements of configuration disclosed in the above embodiments can be combined as appropriate to form various disclosures. For example, some of the elements of configuration in the embodiments may be omitted. Furthermore, elements of configuration in different embodiments may be combined as appropriate. The drawings schematically illustrate elements of configuration in order to facilitate understanding, and properties of elements of configuration illustrated in the drawings, such as thickness, length, number, and spacing, may differ from actual properties thereof in order to facilitate preparation of the drawings. Furthermore, properties of elements of configuration described in the above embodiments, such as rate, material, shape, and size, are merely examples and are not intended as specific limitations. The properties may be altered within a scope not substantially deviating from the configuration of the present disclosure.

What is claimed is:

1. An image forming apparatus comprising:

an image forming section configured to form an image on a sheet;

a fixing device configured to fix the image to the sheet;

an exit tray configured to receive placement of the sheet with the image fixed thereto;

a first conveyance section configured to convey the sheet with the image fixed thereto along a conveyance path;

a duct having an inlet and a first outlet; and an air generator disposed within the duct and configured to generate air directed from the inlet to the first outlet, wherein the inlet is located in a position for sucking in air from a space above the exit tray, the first outlet is in communication with the conveyance path, the first conveyance section has a guide member forming the conveyance path, and the guide member constitutes a part of the duct.

2. The image forming apparatus according to claim 1, wherein the first outlet is located in the guide member.

3. The image forming apparatus according to claim 1, wherein a width of the first outlet is smaller than a width of the inlet.

4. The image forming apparatus according to claim 1, further comprising:

a second conveyance section configured to convey the sheet to the exit tray; and a diverging section configured to guide the sheet being conveyed by the second conveyance section to the first conveyance section, wherein a conveyance destination of the sheet switches between the exit tray and the first conveyance section depending on an angle of the diverging section.

5. The image forming apparatus according to claim 1, further comprising:

a structure including side wall surfaces and a ceiling surface surrounding the space above the exit tray, wherein the inlet is located in a position for sucking in air from a space surrounded by the exit tray, the side wall surfaces, and the ceiling surface.

6. The image forming apparatus according to claim 1, comprising a plurality of the air generators, wherein the duct extends from the inlet to the first outlet, and the air generators are arranged in a width direction orthogonal to an extending direction of the duct.

7. The image forming apparatus according to claim 6, wherein the duct includes at least one partitioning member, and the partitioning member forms flow paths allowing the air generated by the respective air generators to flow to the first outlet.

8. The image forming apparatus according to claim 6, wherein the plurality of the air generators are at least three air generators, and driving force of the air generators corresponding to opposite ends of the sheet in the width direction is greater than driving force of the air generator corresponding to a middle portion of the sheet in the width direction.

9. The image forming apparatus according to claim 1, further comprising a cover covering the first conveyance section, wherein the cover has a second outlet, and the air generated by the air generator is exhausted through the first outlet, and then exhausted through the second outlet via the conveyance path.

10. The image forming apparatus according to claim 9, wherein the first conveyance section conveys the sheet upward, the duct extends in an extending direction of the first conveyance section, the first outlet is located in an upper portion of the duct, and the cover covers an upper portion of the first conveyance section.

11. An image forming apparatus comprising:

an image forming section configured to form an image on a sheet;

a fixing device configured to fix the image to the sheet;

an exit tray configured to receive placement of the sheet with the image fixed thereto;

a first conveyance section configured to convey the sheet with the image fixed thereto along a conveyance path;

a duct having an inlet and a first outlet; and a plurality of air generators each disposed within the duct and configured to generate air directed from the inlet to the first outlet, wherein the duct extends from the inlet to the first outlet, the air generators are arranged in a width direction orthogonal to an extending direction of the duct, the inlet is located in a position for sucking in air from a space above the exit tray, and the first outlet is in communication with the conveyance path.

12. An image forming apparatus comprising:

an image forming section configured to form an image on a sheet;

a fixing device configured to fix the image to the sheet;

an exit tray configured to receive placement of the sheet with the image fixed thereto;

a first conveyance section configured to convey the sheet with the image fixed thereto along a conveyance path;

a duct having an inlet and a first outlet;

an air generator disposed within the duct and configured to generate air directed from the inlet to the first outlet; and a cover covering an upper portion of the first conveyance section, wherein the cover has a second outlet, the duct extends in an extending direction of the first conveyance section, the inlet is located in a position for sucking in air from a space above the exit tray, the first outlet is located in an upper portion of the duct and is in communication with the conveyance path, and the air generated by the air generator is exhausted through the first outlet, and then exhausted through the second outlet via the conveyance path.

* * * * *